US010153569B1

(12) United States Patent
Lopes et al.

(10) Patent No.: US 10,153,569 B1
(45) Date of Patent: Dec. 11, 2018

(54) CARTRIDGE HEATER ASSEMBLY

(71) Applicant: TYCO ELECTRONICS BRASIL LTDA., Braganca Paulista (BR)

(72) Inventors: Ednei Lopes, Braganca Paulista (BR); Natanael Marcondes Santos, Braganca Paulista (BR); Fabio Fortunato Christiano, Itapira (BR); Oswaldo Cella, Jr., Braganca Paulista (BR)

(73) Assignee: TE CONNECTIVITY BRASIL INDUSTRIA DE ELETRONICOS LTDA., Sao Paulo (BR)

( * ) Notice: Subject to any disclaimer, the term of this patent is extended or adjusted under 35 U.S.C. 154(b) by 0 days.

(21) Appl. No.: 15/936,031

(22) Filed: Mar. 26, 2018

Related U.S. Application Data

(60) Provisional application No. 62/512,923, filed on May 31, 2017.

(51) Int. Cl.

| | |
|---|---|
| ***H05B 3/02*** | (2006.01) |
| ***H01R 12/58*** | (2011.01) |
| ***H05B 3/42*** | (2006.01) |
| ***H01R 4/30*** | (2006.01) |

(52) U.S. Cl.
CPC ..... *H01R 12/585* (2013.01); *H01R 4/308* (2013.01); *H05B 3/42* (2013.01)

(58) Field of Classification Search
CPC ..... H05B 1/0272; H05B 3/16; H05B 3/32; H05B 6/105; H05B 6/108
USPC ..... 219/481, 546, 532, 618, 628
See application file for complete search history.

(56) References Cited

U.S. PATENT DOCUMENTS 3,628,105 A * 12/1971 Sakai ..... H01L 23/49534 174/551
4,047,132 A * 9/1977 Krajewski ..... H01P 3/088 333/238
4,296,456 A * 10/1981 Reid ..... H01L 23/057 174/549
4,538,210 A * 8/1985 Schaller ..... H05K 1/184 257/701

* cited by examiner

*Primary Examiner* — Phuong Chi T Nguyen

(57) ABSTRACT

A cartridge heater assembly and method or assembly. The cartridge heater assembly includes a cartridge heater. A first electrical contact member is provided in electrical and mechanical engagement with the cartridge heater. The first electrical contact member has first mounting legs which are dimensioned to be press fit into first openings of a circuit board. A second electrical contact member is provided in electrical and mechanical engagement with the cartridge heater. The second electrical contact member has second mounting legs which are dimensioned to be press fit into second openings of the circuit board. An insulating member is provided between the first electrical contact member and the second electrical contact member.

18 Claims, 4 Drawing Sheets

CARTRIDGE HEATER ASSEMBLY

FIELD OF THE INVENTION

The invention is directed to a cartridge heater assembly. In particular, the invention is directed to a cartridge heater assembly in which a cartridge heater makes a mechanical and electrical connection to a circuit board without the need for soldering.

BACKGROUND OF THE INVENTION

A cartridge heater is a heating element which includes an outer metal enclosure or sheath which contains a resistive heating element or wiring separated from the sheath by electrical insulation. The cartridge heater may be positioned in a cartridge heater assembly which includes a connector, a printed circuit board and the cartridge heater. The cartridge heater is electrically connected to the printed circuit board by means of terminals or wires which must be soldered to the printed circuit board. This can be an expensive and time consuming. In addition, the geometry of the assembly is limited due to the fact that soldering must be accommodated.

It would, therefore, be beneficial to provide a cartridge heater and cartridge heater assembly which can be easily assembled and which does not require soldering to a printed circuit board. In particular, it would be beneficial to provide a cartridge heater which has terminals or electrical contact members provided thereon which can engage and make mechanical and electrical connection with the printed circuit board utilizing press fit technology.

SUMMARY OF THE INVENTION

An embodiment is directed to a cartridge heater assembly. The cartridge heater assembly includes a cartridge heater. A first electrical contact member is provided in electrical and mechanical engagement with the cartridge heater. The first electrical contact member has first mounting legs which are dimensioned to be press fit into first openings of a circuit board. A second electrical contact member is provided in electrical and mechanical engagement with the cartridge heater. The second electrical contact member has second mounting legs which are dimensioned to be press fit into second openings of the circuit board. An insulating member is provided between the first electrical contact member and the second electrical contact member.

An embodiment is directed to an electrical connector assembly. The electrical connector assembly has a housing, a circuit board and a cartridge heater assembly. The housing has a cavity which receives the circuit board therein. The cartridge heater assembly comprising has a cartridge heater having a raised member provided at an end of the cartridge heater and a projection which extends from the end of the cartridge heater. The projection extends through, but is isolated from, the raised member. A first electrical contact member has first contact projections positioned on, and spaced periodically along, an opening in the first electrical contact member. The first contact projections are provided in electrical engagement with the raised member. The first electrical contact member has first mounting legs which are dimensioned to be press fit into first openings of the circuit board. A second electrical contact member has second contact projections positioned on, and spaced periodically along an opening in the second electrical contact member. The second contact projections are provided in electrical engagement with the projection of the cartridge heater. The second electrical contact member has second mounting legs which are dimensioned to be press fit into second openings of the circuit board. An insulating member is provided between the first electrical contact member and the second electrical contact member.

An embodiment is directed to a method of assembling an electrical connector assembly having a cartridge heater assembly. The method includes: forming the cartridge heater assembly by assembling a first electrical contact member to a cartridge heater; assembling an insulator member over the first electrical contact member; and assembling a second electrical contact member to the cartridge heater. The method also includes overmolding a housing over the cartridge heater assembly and pressing ends of the first electrical contact member and the second electrical contact member into openings of a circuit board positioned in a cavity of the housing.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
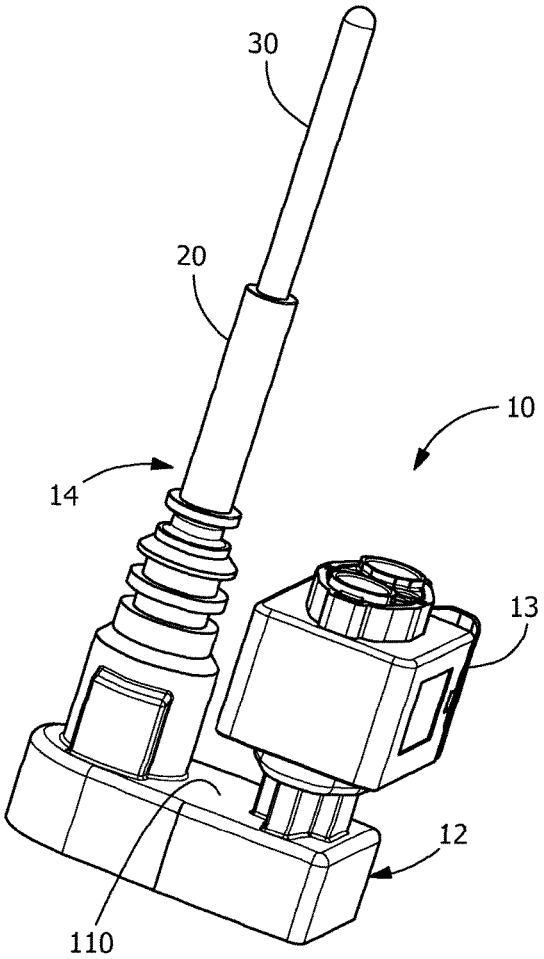
FIG. 1 is a top perspective view of an illustrative embodiment of an electrical connector assembly having a cartridge heater assembly according to the present invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

Figure 2:
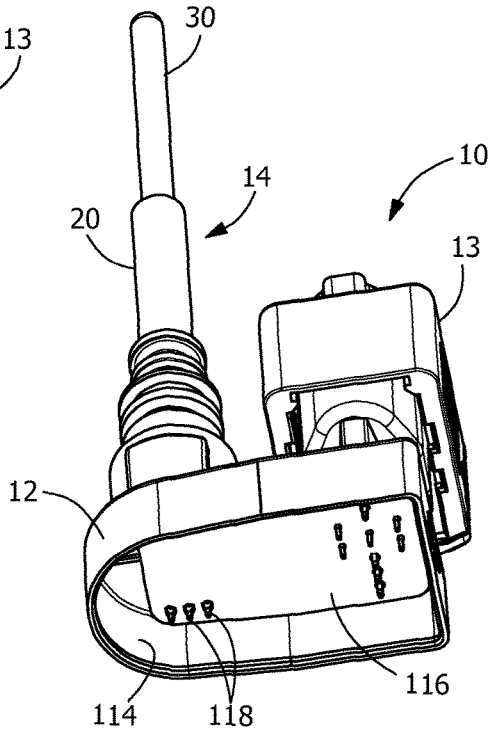
FIG. 2 is a bottom perspective view of the electrical connector assembly of FIG. 1.

Referring to FIGS. 1 and 2, an illustrative embodiment of a connector assembly 10 is shown. The connector assembly 10 has a base housing 12, a connector module 14 extending from the base housing 12 and a cartridge heater assembly 14. The connector module 14 shown is an illustrative representation, other types of connector modules may be used without departing from the scope of the invention. As best shown in FIG. 2, the base housing 12 includes a recess or cavity 116 in which a printed circuit board 116 is provided.

Figure 3:
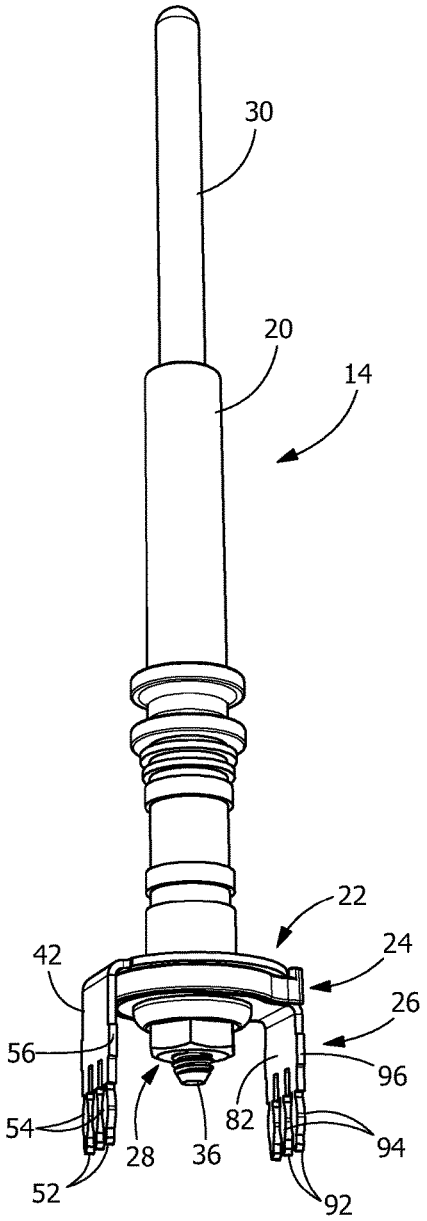
FIG. 3 is a perspective view of an illustrative embodiment of the cartridge heater assembly of the present invention which is used in the cartridge heater assembly of FIG. 1.
Figure 4:
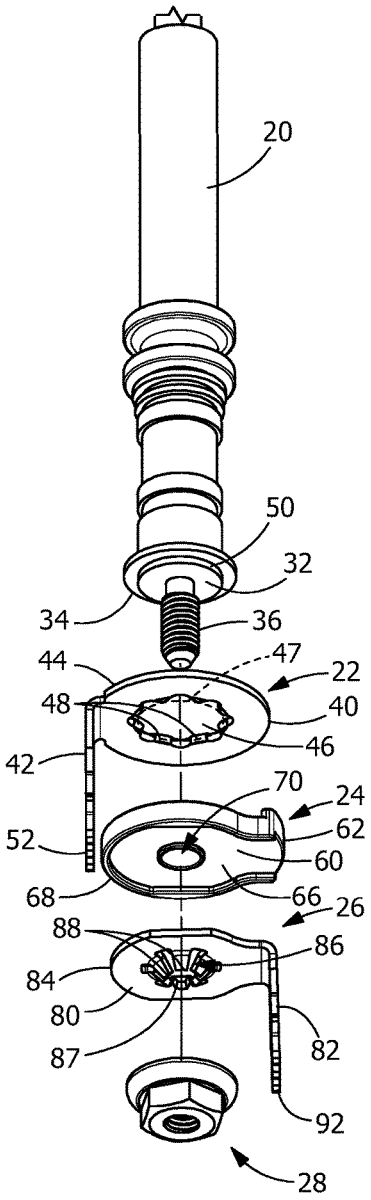
FIG. 4 is a perspective exploded view of a connection end of the cartridge heater assembly of FIG. 3.

As best shown in FIGS. 3 and 4, the cartridge heater assembly 16 includes a cartridge heater 20, a first electrical contact member 22, an isolator member 24, a second electrical contact member 26 and a fastening member 28.

The cartridge heater 20 has a heating coil (not shown), insulation (not shown) and a sheath 30. As is known in the industry, the heating coil is the actual resistance which is where the electrical load occurs. The heating coil may be a wire which is wound around a core, with the number of spirals per inch varying according to the requested watt density. Potential from the electrical current source flows through the coiled wire, heating the wire, which in turn, heats the sheath. The insulation prevents the coil from contacting the sheath. The sheath 30 is the part of the cartridge heater which makes contact with the material or substance to be heated.

As best shown in FIG. 3, the cartridge heater 20 has raised circular member 32 provided at an end 34 of the cartridge heater 20. The raised circular member 32 is provided in electrical engagement with a first end of the heating coil. The raised circular member 32 is made from any material having the required electrically conductive properties. A threaded projection 36 extends from the end 34 of the cartridge heater 20. The threaded projection 36 extends through, but is isolated from, the raised circular member 32. The threaded projection 36 is provided in electrical engagement with a second end of the heating coil. The threaded projection 36 is made from any material having the required strength and electrically conductive properties.

Figure 5:
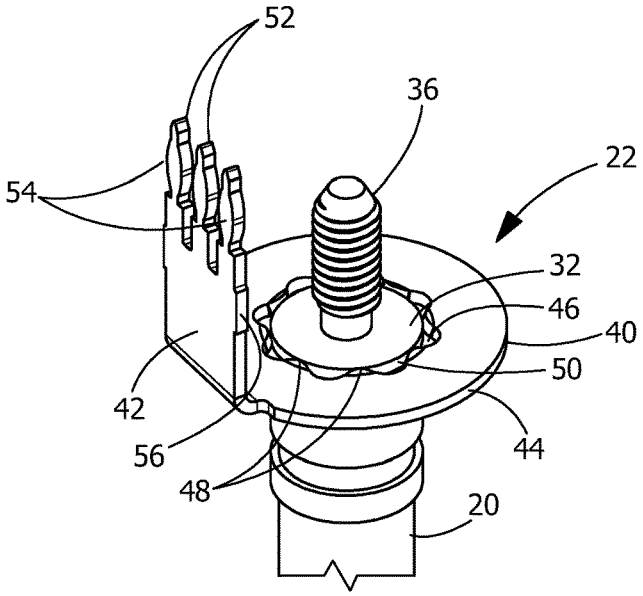
FIG. 5 is a bottom view of a first electrical contact member of the cartridge heater assembly in electrical and mechanical engagement with a heating portion of the cartridge heater.
Figure 6:
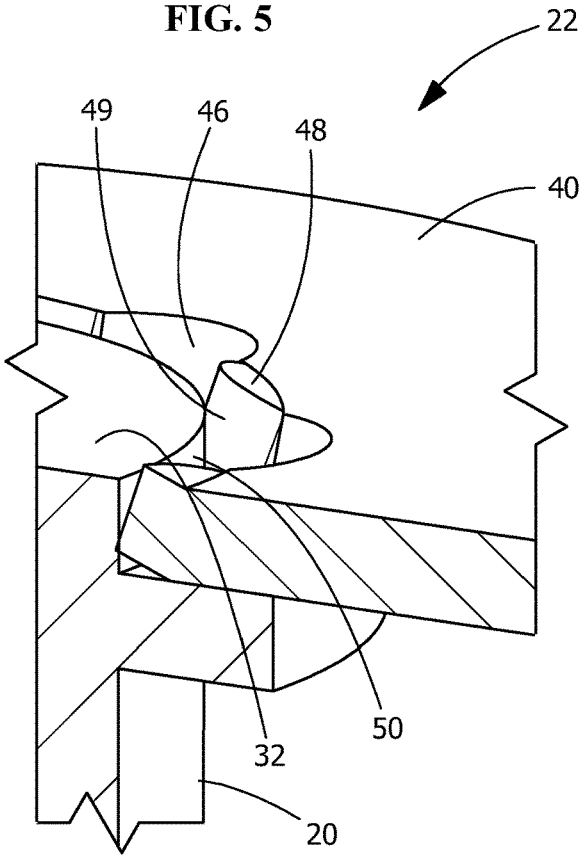
FIG. 6 is an enlarged cross-sectional perspective view of the engagement between the first electrical contact member and the heating portion.

As best shown in FIGS. 4 through 6, the first electrical contact member 22 has a generally circular cartridge heater engagement member 40 and a printed circuit board engagement member 42 extending from an outer edge 44 of the cartridge heater engagement member 40. The printed circuit board engagement member 42 extends in a plane which essentially perpendicular to the plane of the cartridge heater engagement member 40.

The cartridge heater engagement member 40 has a first opening 46 provided at the center thereof. First contact projections 48 are positioned on, and are spaced periodically along a wall 50 of the opening 46. The contact projections 48 extend from the wall 50 into the opening 46. The contact projections 48 form a smaller inner opening 47, as represented by the dotted line in FIG. 4. The inner opening 47 has a diameter which is less than the diameter of the raised circular member 32.

The printed circuit board engagement member 42 has one or more first circuit board engaging projections 52 which extend from the printed circuit board engagement member 42 in a direction away from the cartridge heater engagement member 40. The circuit board engaging projections 52 have enlarged sections 54 which are configured to be press fit into openings of a printed circuit board or other type of substrate. Securing projections 56 extend from sides of the printed circuit board engagement member 42.

When inserted onto the cartridge heater 20, the opening 46 of the cartridge heater engagement member 40 aligns with the raised circular member 32. As insertion continues, ends of the contact projections 48 of the cartridge heater engagement member 40 engage the raised circular member 32. As the inner opening 47 has a diameter which is less than the diameter of the raised circular member 32, the contact projections 48 are caused to resiliently deform, as shown in FIG. 6, causing ends 49 (FIG. 6) of the contact projections 48 to frictionally engage the walls of the raised circular member 32.

As best shown in FIG. 6, when the cartridge heater engagement member 40 is fully inserted onto the raised circular member 32, the contact projections 48 of the cartridge heater engagement member 40 are provided in electrical and mechanical engagement with the raised circular member 32. Due to the resilient deformation of the contact projections 48, the cartridge heater engagement member 40 and the first electrical contact member 22 are maintained in position on the raised circular member 32.

Figure 7:
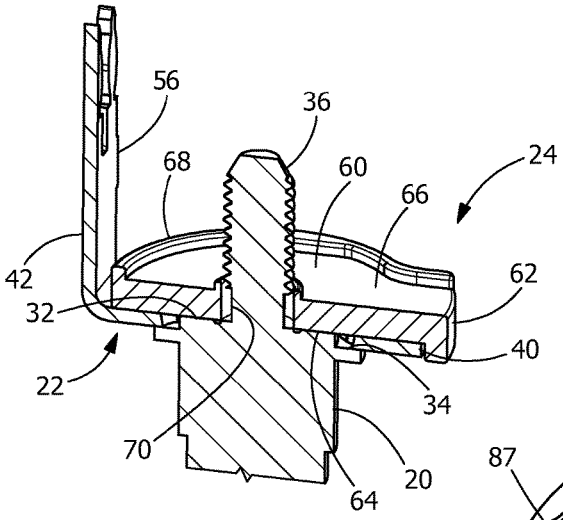
FIG. 7 is an enlarged cross-sectional perspective view of an insulation member of the cartridge heater assembly positioned over the first electrical contact member.

With the first electrical contact member 22 properly positioned on the cartridge heater 20, the isolator member 24 is positioned over the first electrical contact member 22, as shown in FIG. 7.

The isolator member 24 has a generally circular main portion 60 with flat positioning portion 62 extending therefrom. The isolator member 24 has a first surface 64 which engages the first electrical contact member 22 and a second surface 66 which engages the second electrical contact member 26. A raised wall 68 is provided about the perimeter of the second surface 66.

The isolator member 24 has an opening 70 provided at the center thereof. The opening 70 has a diameter which is less than the diameter of the raised circular member 32 but larger than the diameter of the threaded projection 36, thereby allowing the threaded projection 36 to be inserted therethrough.

When inserted onto the cartridge heater 20, the opening 70 of the isolator member 24 aligns with the threaded projection 36. The isolator member 24 may be made from material having the appropriate dielectric properties to prevent the flow of current between the first electrical contact member 22 and the second electrical contact member 26.

With the first electrical contact member 22 and the isolator member 24 properly positioned on the cartridge heater 20, the second electrical contact member 26 is positioned over the isolator member 24, as shown in FIG. 7.

Figure 8:
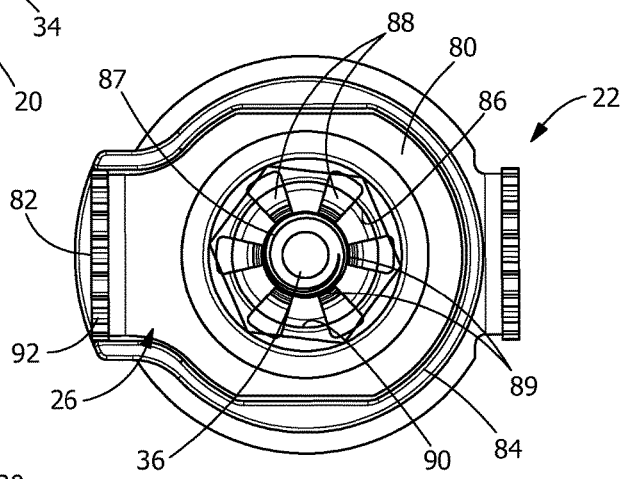
FIG. 8 is a bottom view of a second electrical contact member of the cartridge heater assembly in electrical and mechanical engagement with a heating portion of the cartridge heater.
Figure 9:
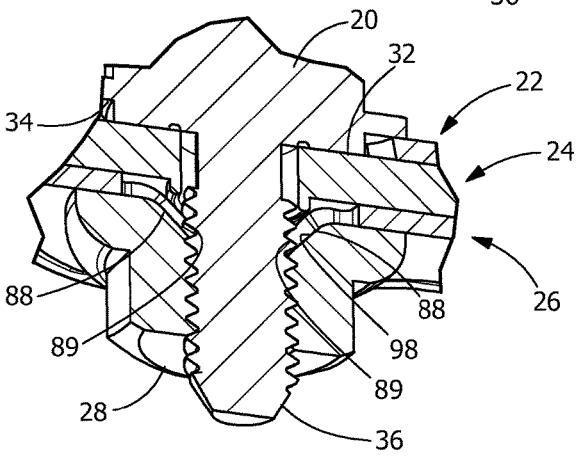
FIG. 9 is an enlarged cross-sectional perspective view of the engagement between the second electrical contact member and the heating portion.

As best shown in FIGS. 4, 8 and 9, the second electrical contact member 26 has a generally circular cartridge heater engagement member 80 and a printed circuit board engagement member 82 extending from an outer edge 84 of the cartridge heater engagement member 80. The printed circuit board engagement member 82 extends in a plane which is essentially perpendicular to the plane of the cartridge heater engagement member 80.

The cartridge heater engagement member 80 has a second opening 86 provided at the center thereof. Second contact projections 88 are positioned on, and are spaced periodically along, a wall 90 of the opening 86. The contact projections 88 extend from the wall 90 into the opening 86. The contact projections 88 form a smaller inner opening 87, as represented by the dotted line in FIG. 4. The inner opening 87 has a diameter which is less than the diameter of the threaded projection 36.

The printed circuit board engagement member 82 has one or more second circuit board engaging projections 92 which extend from the printed circuit board engagement member 82 in a direction away from the cartridge heater engagement member 80. The circuit board engaging projections 92 have enlarged sections 94 which are configured to be press fit into openings of a printed circuit board or other type of substrate. Securing projections 96 extend from sides of the printed circuit board engagement member 82.

When inserted onto the cartridge heater 20, the opening 86 of the cartridge heater engagement member 80 aligns with the threaded projection 36. As insertion continues, ends of the contact projections 88 of the cartridge heater engagement member 80 engage the threaded projection 36. As the inner opening 87 has a diameter which is less than the diameter of the threaded projection 36, the contact projections 88 are caused to resiliently deform, as shown in FIG. 9, causing ends 89 of the contact projections 88 to frictionally engage the threads of the threaded projection 36.

As best shown in FIG. 9, when the cartridge heater engagement member 80 is fully inserted onto the threaded projection 36, the contact projections 88 of the cartridge heater engagement member 80 are provided in electrical and mechanical engagement with the threaded projection 36. Due to the resilient deformation of the contact projections 88, the cartridge heater engagement member 80 and the second electrical contact member 26 are maintained in position on the threaded projection 36.

With the first electrical contact member 22, the isolator member 24 and the second electrical contact member 26 positioned on the cartridge heater 20, the fastening member 28 is positioned on and secured to the threaded projection 36. In the embodiment shown, the fastening member is a threaded nut, but other types of fastening members may be used without departing from the scope of the invention. As shown in FIG. 9, the fastening member 28 has a recess 98 which receives the ends of the contact projections 88 therein when the fastening member 28 is fully inserted onto the threaded projection 36.

When the fastening member 28 is fully inserted onto the threaded projection 36, the first electrical contact member 22, the isolator member 24 and the second electrical contact member 26 are securely maintained in position on the cartridge heater 20. This allows the cartridge heater assembly 16 to be used in environments which experience significant vibration, such as, but not limited to, an engine compartment.

In the illustrative embodiment shown, the cartridge heater assembly 16 is positioned in a mold cavity and the base housing 12 of the connector assembly 10 is overmolded onto the cartridge heater assembly 14. As best shown in FIG. 2, when the base housing 12 is molded on the cartridge heater assembly 14, the enlarged sections 54 of the circuit board engaging projections 52 of the printed circuit board engagement member 42 of the first electrical contact member 22 extend through an upper surface 110 of the base housing 12. In addition, the enlarged sections 94 of the circuit board engaging projections 92 of the printed circuit board engagement member 82 of the second electrical contact member 26 extend through the upper surface 110 of the base housing 12. The enlarged sections 54, 94 extend into a cavity 116 of the base housing 12. Contact members 115 which are provided in electrical engagement with the connector module 14 also extend through the upper surface 112 into the cavity 114.

A printed circuit board 116 is positioned in the cavity. Through holes 118 of the printed circuit board 116 are provided and are positioned in electrical and mechanical engagement with the enlarged sections 54 of the circuit board engaging projections 52 of the first electrical contact member 22, the enlarged sections 94 of the circuit board engaging projections 92 of the second electrical contact member 26, and with the contact members 115 of the connector module 14. The enlarged sections 54, 94 form a frictional engagement or press fit with the through holes 118 of the circuit board 116.

With the circuit board 116 properly positioned in the cavity 114, a resin or epoxy (not shown) is positioned in the cavity 114. The resin fills the cavity 116 and seals the circuit board 116, the enlarged sections 54 of the circuit board engaging projections 52 of the printed circuit board engagement member 42 of the first electrical contact member 22, and the enlarged sections 94 of the circuit board engaging projections 92 of the printed circuit board engagement member 82 of the second electrical contact member 26 from environmental conditions.

The printed circuit board engagement member 42 has one or more circuit board engaging projections 52 which extend from the printed circuit board engagement member 42 in a direction away from the cartridge heater engagement member 40. The circuit board engaging projections 52 have enlarged sections 54 which are configured to be press fit into openings of a printed circuit board or other type of substrate. Securing projections 56 extend from sides of the printed circuit board engagement member 42.

The cartridge heater assembly as described herein can be easily assembled and does not require soldering to a printed circuit board. The use of the first and second electrical contact members provides greater flexibility in design and allows for greater modularity of the connector assembly.

While the invention has been described with reference to a preferred embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials and components, without departing from the spirit or essential characteristics thereof. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A cartridge heater assembly comprising:

a cartridge heater;

a first electrical contact member in electrical and mechanical engagement with the cartridge heater, the first electrical contact member having first mounting legs which are dimensioned to be press fit into first openings of a circuit board;

a second electrical contact member in electrical and mechanical engagement with the cartridge heater, the second electrical contact member having second mounting legs which are dimensioned to be press fit into second openings of the circuit board;

an insulating member provided between the first electrical contact member and the second electrical contact member;

wherein the first electrical contact member has a generally circular cartridge heater engagement member and a printed circuit board engagement member extending from an outer edge of the cartridge heater engagement member;

wherein the cartridge heater has a raised circular member provided at an end of the cartridge heater, the raised circular member is provided in electrical engagement with a first end of a heating coil, the opening of the cartridge heater engagement member aligns with the raised circular member and the contact projections frictionally engage the raised circular member.

2. The cartridge heater assembly as recited in claim 1, wherein the printed circuit board engagement member extends in a plane which essentially perpendicular to the plane of the cartridge heater engagement member.

3. The cartridge heater assembly as recited in claim 1, wherein the cartridge heater engagement member has an opening provided at the center thereof, contact projections are positioned on, and are spaced periodically along, the opening and extend into the opening.

4. The cartridge heater assembly as recited in claim 1, wherein the printed circuit board engagement member has one or more circuit board engagement projections which extend from the circuit board engagement member in a direction away from the cartridge heater engagement member, the one or more circuit board engagement projections have enlarged sections which are configured to be press fit into the first openings of the circuit board.

5. The cartridge heater assembly as recited in claim 1, wherein a fastening member is provided to retain the first electrical contact member, second electrical contact member and insulating member in position on the cartridge heater.

6. The cartridge heater assembly as recited in claim 1, wherein the second electrical contact member has a generally circular cartridge heater engagement member and a printed circuit board engagement member extending from an outer edge of the cartridge heater engagement member.

7. The cartridge heater assembly as recited in claim 6, wherein the printed circuit board engagement member extends in a plane which is essentially perpendicular to the plane of the cartridge heater engagement member.

8. The cartridge heater assembly as recited in claim 6, wherein the cartridge heater engagement member has an opening provided at the center thereof, contact projections are positioned on, and are spaced periodically along, the opening and extend into the opening.

9. The cartridge heater assembly as recited in claim 6, wherein the printed circuit board engagement member has one or more circuit board engaging projections which extend from the printed circuit board engagement member in a direction away from the cartridge heater engagement member, the one or more circuit board engaging projections have enlarged sections which are configured to be press fit into the second openings of the circuit board.

10. The cartridge heater assembly as recited in claim 8, wherein a projection extends from the end of the cartridge heater, the projection is provided in electrical engagement with a second end of the heating coil, the projection extends through, but is isolated from, a raised circular member provided at an end of the cartridge heater, the raised circular member is provided in electrical engagement with a first end of a heating coil, the opening of the cartridge heater engagement member aligns with the projection and the contact projections frictionally engage the projection.

11. The cartridge heater assembly as recited in claim 10, wherein the projection is threaded.

12. An electrical connector assembly comprising:

a housing having a cavity;

a circuit board received in the cavity of the housing;

a cartridge heater assembly comprising:

a cartridge heater having a raised member provided at an end of the cartridge heater and a projection which extends from the end of the cartridge heater, the projection extends through, but is isolated from, the raised member;

a first electrical contact member having first contact projections positioned on, and spaced periodically along, an opening in the first electrical contact member, the first contact projections are provided in electrical engagement with the raised member, the first electrical contact member having first mounting legs which are dimensioned to be press fit into first openings of the circuit board;

a second electrical contact member having second contact projections positioned on, and spaced periodically along, an opening in the second electrical contact member, the second contact projections are provided in electrical engagement with the projection of the cartridge heater, the second electrical contact member having second mounting legs which are dimensioned to be press fit into second openings of the circuit board;

an insulating member provided between the first electrical contact member and the second electrical contact member.

13. The electrical connector assembly as recited in claim 12, wherein a resin or epoxy is positioned in the cavity.

14. The electrical connector assembly as recited in claim 12, wherein the housing is overmolded onto the cartridge heater assembly.

15. A method of assembling an electrical connector assembly having a cartridge heater assembly, the method comprising:

forming the cartridge heater assembly by:

assembling a first electrical contact member to a cartridge heater;

assembling an insulator member over the first electrical contact member;

assembling a second electrical contact member to the cartridge heater;

overmolding a housing over the cartridge heater assembly;

pressing ends of the first electrical contact member and the second electrical contact member into openings of a circuit board positioned in a cavity of the housing;

wherein the cartridge heater has a raised circular member provided at an end of the cartridge heater, the raised circular member is provided in electrical engagement with a first end of a heating coil, the opening of the cartridge heater engagement member aligns with the raised circular member and the contact projections frictionally engage the raised circular member.

16. The method of claim 15, wherein forming the cartridge header assembly comprising frictionally engaging the first electrical contact member to a raised member of a cartridge heater.

17. The method of claim 15, wherein forming the cartridge header assembly comprising frictionally engaging the second electrical contact member to a projection of a cartridge heater.

18. The method of claim 15, comprising filling the cavity with resin or epoxy.

* * * * *